United States Patent [19]

Tack

[11] 4,203,371

[45] May 20, 1980

[54] RESILIENT PEDESTAL WEAR PLATE

[75] Inventor: Carl E. Tack, Elmhurst, Ill.

[73] Assignee: Transdyne, Inc., Chicago, Ill.

[21] Appl. No.: 922,749

[22] Filed: Jul. 7, 1978

[51] Int. Cl.[2] ..... B61F 5/32; B61F 5/38; B61F 5/50

[52] U.S. Cl. ..... 105/225; 105/218 R

[58] Field of Search ..... 105/225, 218 R

[56] References Cited

U.S. PATENT DOCUMENTS

| | | | |
|---|---|---|---|
| 1,410,516 | 3/1922 | Sandman | 105/225 |
| 3,897,736 | 8/1975 | Tack | 105/225 |

*Primary Examiner*—Howard Beltran

*Attorney, Agent, or Firm*—Gary, Juettner & Pyle

[57] ABSTRACT

A wear plate is installed on the downwardly facing surface of the pedestal opening of the side frame of a railway truck. The wear plate includes a base and a pair of lips extending upward from opposite sides of the base. The lips resiliently engage or clamp onto opposite sides of the pedestal with the base protecting the downwardly facing surface. The base is slightly bowed and is formed a convex shape relative to the downwardly facing surface before installation, such that upon installation, the base of the plate is free of undesirable distortions.

7 Claims, 8 Drawing Figures

RESILIENT PEDESTAL WEAR PLATE

BACKGROUND OF THE INVENTION

This invention relates to improvements in a wear plate that is specifically designed for convenient and removable installation in the pedestal opening of a railway side frame in order to prevent wear on the load bearing surface of the pedestal. Normally, a bearing adaptor is provided over the axle bearing, said adaptor having a slightly arcuate top surface which bears directly against a corresponding downwardly facing surface in the pedestal opening of the side frame.

In service, limited movement or frictional sliding occurs between the bearing adaptor and the pedestal surface, which may cause worn spots on the frame, resulting in sloppiness and a weakening of the frame at a load bearing location. Repair of the frame surface is both expensive and time consuming, since the worn surface must be ground down and renewed by welding a plate in the opening.

In my U.S. Pat. No. 3,897,736, there is disclosed a renewable wear plate which is removably attached to the side frame in the pedestal opening and constitutes a wear surface against the bearing adaptor. The plate has resilient side lips which resiliently clamp against the sides of the frame and tend to hold the plate in position during installation and service. Means are provided between the frame and the plate to limit longitudinal movement of the plate relative to the frame, in order to minimize wear on the frame.

Although the wear plate described in the aforesaid patent is economical and easy to use, difficulties have arisen because of possible variations in the width of the side frame casting. The wear plate described in U.S. Pat. No. 3,897,736 has a flat bottom wall defining the wear surface, and when clipped onto a side frame having a nominal or less than nominal width (within permitted tolerance range), the wear surface remains flat on the flat surface in the pedestal opening.

Experience has shown that the width of the side frame castings as currently manufactured is almost always greater than the nominal width. For example, if the nominal width at the pedestal roof is 6 inches, the dimension of most side frames will significantly exceed this figure and will typically measure in the order of about 1/16 inches greater than nominal.

The wear plate of the aforesaid patent have opposed lips or flanges extending from the base. The lips are spaced sufficiently, i.e., in the order of 5¾ inches, so that the wear plate may be pressed onto the pedestal roof and the lips will resiliently grip the sides of the pedestal, thereby holding the wear plate in position but still allowing for easy removal.

In connection with the above discussion regarding the spacing between the lips, it is apparent that the spacing must be maintained at a fixed maximum dimension that will insure proper gripping of those occasional side frame castings that have nominal or less than nominal width.

It has been found, however, that the aforesaid wear plate having a flat bottom plate and a fixed maximum dimension between the lips is not ideally suited for side frames having greater than nominal width. Upon installation of the wear plate, the lips are pushed or distended outwardly beyond design limitations. This in turn causes the bottom wall of the plate to bow in a concave fashion, thereby creating an excessive gap between the pedestal roof and the wear plate near the edges. This in turn causes a dramatic increase in the stress in the plate when the gap is forced to close due to movement of the side frame and axle bearing adaptor toward each other.

As a result of the foregoing situation, the nominal stress level on the wear plate may be doubled. This higher stress, coupled with a wide stress range, as cycling takes place, can result in early fatigue failure of the lip or flange, and complete loss of the gripping force.

SUMMARY OF THE INVENTION

The foregoing problems encountered in a wear plate of the foregoing type having a base and a pair of lips, are solved or minimized by forming the bottom wall of the plate to have a convex or cylindrical configuration on an axis parallel to the lips. The radius of curvature of the bottom wall will be in the order of from about 62 to about 124 inches, and the lips will be spaced the same distance as in the prior art version. The curvature is imparted to the base during the forming thereof.

The aforesaid curvature in the base allows the wear plate to be installed on wider than nominal side frames, whereupon the base assumes a substantially flat shape, and the excessive gap due to excessive expansion of the lips is greatly reduced or eliminated. The pre-formed curvature in the base allows the spacing between the lips to be kept at that minimum required side frames of less than nominal width.

THE DRAWINGS

DESCRIPTION OF THE PREFERRED EMBODIMENT

For the sake of brevity, the teachings of my U.S. Pat. No. 3,897,736 are incorporated herein by reference, and the present invention represents an improvement over the wear plate shown in said patent.

Figure 1:
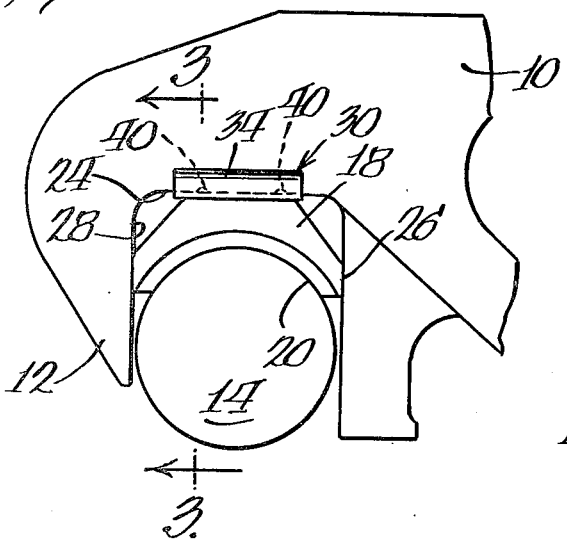
FIG. 1 is a fragmentary elevational view of one end of a railway truck side frame and axle, including the wear plate of the present invention.

It will be understood to those skilled in the art that the drawings show only a fragmentary portion of a railway truck, which includes a pair of spaced side frames supported on wheel and axle assemblies, and a bolster connected between the side frames for supporting the car body. FIG. 1 illustrates one end of a side frame 10 terminating in the pedestal 12 in the form of a downwardly open pedestal jaw engaged over the axle 14 on which the car wheels are mounted.

Figure 2:
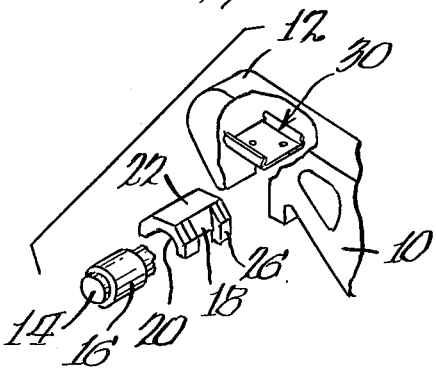
FIG. 2 is an expanded perspective view, with portions cut away, of the side frame and axle assembly of FIG. 1, further illustrating the component parts thereof in disassembly.
Figure 4:
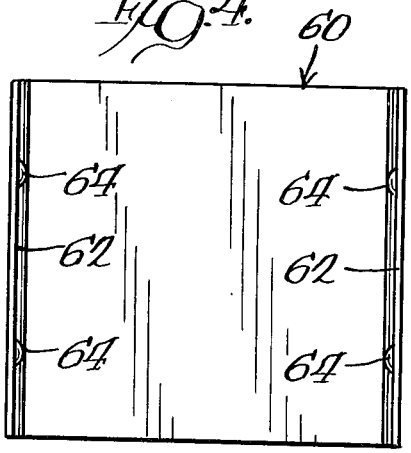
FIG. 4 is a plan view of another embodiment of the wear plate of the present invention.

As shown in FIGS. 2 and 4, a roller bearing 16 is carried on the axle 14 near the end thereof, and a bearing adaptor 18 is provided between the top portion of the bearing and the internal surfaces of the pedestal 12. The downwardly facing surface of the adaptor 18 is curved at 20 to correspond to the cylindrical outer race of the bearing 16, and the upper portion of the adaptor comprises a top slightly convex surface 22 which normally bears against a downwardly facing flat surface 24 in the pedestal opening. In addition, side surfaces 26 are provided on the adaptor 18 in engagement with corresponding surfaces 28 in the pedestal opening. Thus the upper portion of the adaptor is generally rectangular so as to be received in the rectangular pedestal opening or roof, although the adapter corners are omitted or cut away to prevent galling of the corners in the pedestal opening.

The foregoing parts are conventional and details therof are readily available to the public. It will also be understood that the pedestal at the other end of the side frame is identical to the one described above.

As shown in FIGS. 1–5, the wear plate 30 of U.S. Pat. No. 3,897,736 is in the form of a rectangular flat base plate 32, said plate having a pair of integrally formed lips 34 extending upwardly from opposite sides thereof, said lips being adapted to resiliently clamp inward toward one another against the opposite side surfaces of the pedestal 12 adjoining the central portion of the downwardly facing surface 24. As shown, the lips 34 are co-extensive with the length of the base plate 32, which facilitates fabrication of the wear plate from a single rectangular metal or steel sheet, although any suitable lip configuration may be employed. It will be noted that the base of the lips 34 each bulge outwardly in an arc at 33 beyond the width of the base plate 32, and the upper edges 38 are inwardly spaced from the base of the lips but are also flared out at their ends to facilitate installation.

The minimum dimension between the lips 34 is smaller than the width of the base plate 32 and the transverse thickness of the pedestal, such that the lips resiliently clamp against the sides of the side frame after the wear plate has been installed. The bulges 33 in the lips serve to accommodate corresponding bulges which are normally cast in the side frame, as shown in FIG. 4. The clamping action of the lips 34 against the side frame serve to minimize side-to-side movement of the wear plate relative to the frame.

Figure 3:
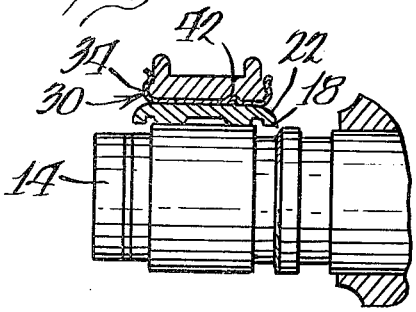
FIG. 3 is a transverse sectional view taken along section line 3—3 of FIG. 1.

Additional means are provided to minimize movement of the wear plate on the downwardly facing surface 24 of the pedestal opening. The preferred means is shown in FIGS. 1–3 and comprises at least one, and preferably two or more, longitudinally and laterally spaced protrusions or convex bumps 40 in the upper surface of the base plate 32, and corresponding shallow depressions 42 (FIG. 4) in the downwardly facing surface 24 which conformably receive said bumps. Movement of the bumps 40 out of register with the depressions 42 is prevented because of the considerable load on the friction plate. The restraint feature serves primarily to prevent longitudinal movement of the plate into the corner of the pedestal opening, although it may be seen that lateral movement is also minimized thereby.

FIG. 4 illustrates another version of a wear plate 60 having the same lips 62, but having the bumps 64 formed on the lips instead of the base plate. It is understood that corresponding recesses would be provided in the sides of the pedestal to receive the bumps 64.

Figure 5:
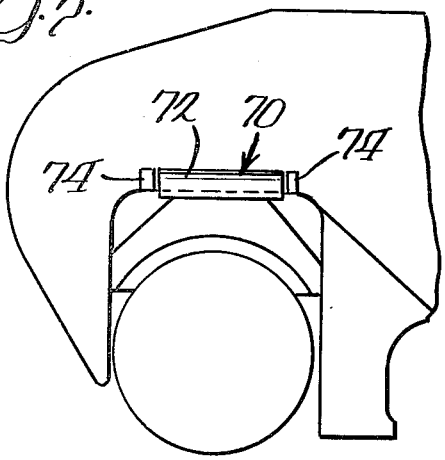
FIG. 5 is a view similar to FIG. 1 but further illustrating stops on the frame in engagement with the ends of the wear plate.

FIG. 5 illustrates still another means of imposing longitudinal restraint on a wear plate 70 having the usual lips 72 in engagement with the sides of the pedestal. In this embodiment, the sides of the side frame are provided with pairs of longitudinally spaced stops 74 which engage the opposite end surfaces of the lips and prevent longitudinal movement of the plate.

In summary, the wear plate 30 of the aforesaid patent is essentially resiliently capped over the surface to be protected on the side frame, which prevent accidental vertical dislodgment of the plate after installation. The plate is centrally mounted against the downwardly facing flat surface 24 of the pedestal opening, and the ends thereof are spaced from the corners of the opening, in order to prevent wear thereof by the plate. Since no welding or bolting of the plate is required, installation and removal of the plate may be effected very easily with simple tools.

In order to install the plate, the side frame 10 is lifted away from the axle 14, and the shallow recesses 42 are drilled in the downwardly facing surface 24, and the wear plate 30 is pushed onto the side frame, whereupon the truck may be reassembled.

As explained hereinbefore, the nominal width of the side frame at the pedestal opening is six inches, with a maximum tolerance at 6 1/16 and minimum tolerance of $5\frac{7}{8}$ inches. The distance between the gripping surfaces of the lips is a maximum of $5\frac{3}{4}$ inches, to assure gripping on minimum width frames.

Figure 6:
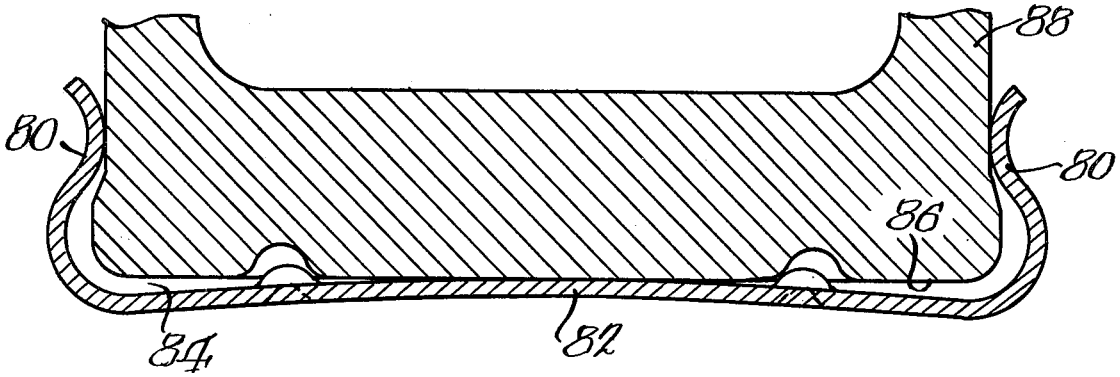
FIG. 6 illustrates an end sectional view of a wear plate of the prior art having been installed on a wider than nominal side frame.

FIG. 6 illustrates the problem created when a flat bottom wear part of the prior art is installed on a frame 88 having a maximum tolerance. The lips or flanges 80, having a maximum spacing of $5\frac{3}{4}$ inches, are then excessively distended, which also causes the bottom wall to diflect or distort into a concave configuration as shown. As a result, an excessive gap 84 is created between the sides of the plate and the flat pedestal roof 86. These gaps may result in increased stresses on the plate when the gaps are closed during service conditions, and repeated flexings may cause failure of the plate at the sides.

Figure 7:
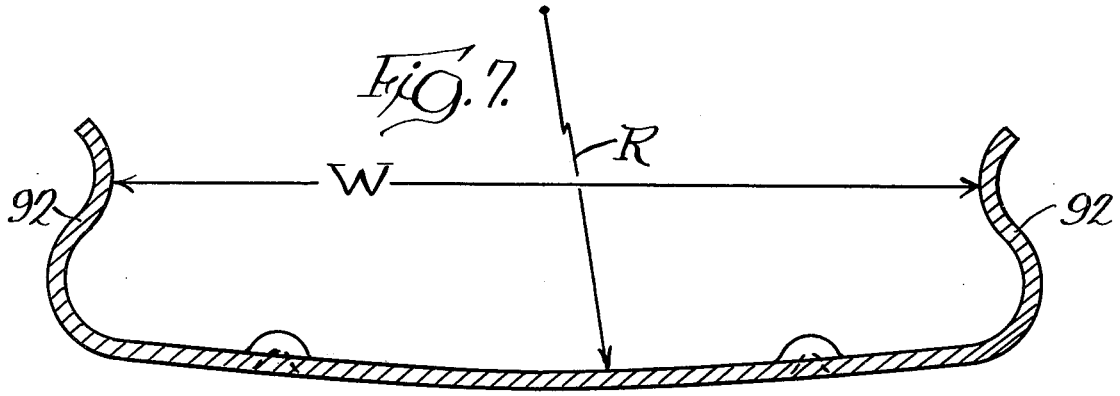
FIG. 7 illustrates an end sectional view of the wear plate of the present invention.

In order to overcome the foregoing problem, the wear plate of the present invention, as shown in FIG. 7, while being otherwise identical to the plate described hereinbefore, if formed with an arcuate convex bottom wall 90 extending between the lips 92 thereof. The curvature on the bottom wall is substantially cylindrical about an axis perpendicular to the lips and has a radius R in the order of from about 62 inches to about 124 inches. The base curvature is easily and conveniently pre-formed during the formation of the entire wear plate.

Figure 8:
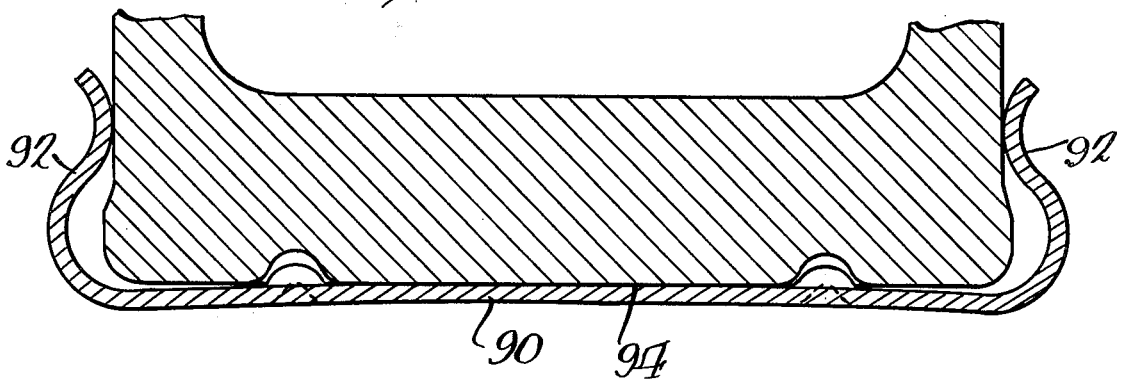
FIG. 8 illustrates the wear plate of FIG. 7 having been installed on a wider than nominal side frame.

The improved wear plate as shown in FIG. 7 has the same maximum dimension W between the lips, but due to the pre-formed bottom wall, is capable of being applied to the wider frames without the distortion and creation of undesirable excessive gaps illustrated in FIG. 6. FIG. 8 illustrates the configuration of the improved plate of FIG. 7 after having been applied to a greater than nominal width frame. The increased outward extension on the lips 92 causes the normally curved bottom plate 90 to assume a flat or nearly flat condition, although the improved plate of FIG. 7 has the same nominal spacing between the lips as the prior art plate.

In view of the foregoing, it may be seen that the improved wear plate is capable of being applied on frames having under- to over-tolerance widths while at the same time eliminating the serious distortion problems encountered when a flat plate was installed on a wider frame.

I claim:

1. An improved wear plate for installation on a downwardly facing flat surface in the pedestal opening of the side frame of a railway truck, said wear plate comprising a U-shaped member for covering and protecting said surface, a pair of lips extending upwardly from opposite sides of a base, said lips being resiliently engageable in clamped relation with opposite sides of the side frame above said flat surface of said pedestal opening to hold said base in position, said base having a slight convex shape relative to said downwardly facing surface prior to the installation thereof, such that after installation, said base reliably conforms to said flat surface.

2. The wear plate of claim 1 wherein each of said lips has a bulge at the base thereof.

3. The wear plate of claim 2 wherein the upper portion of said lips are spaced from each other for a distance which is less than the corresponding thickness of the side frame, and the ends of said lips are flared outwardly.

4. The wear plate of claim 1 wherein means are provided between said wear plate and said flat surface to minimize relative movement therebetween comprising a plurality of protrusions on said base, and a corresponding plurality of recesses in said downwardly facing flat surface receiving said protrusions.

5. The wear plate of claim 1 wherein means are provided to minimize movement between said wear plate and said side frame comprising a plurality of protrusions on said lip, and a corresponding plurality of recesses in said side frame receiving said protrusions.

6. The wear plate of claim 1 wherein means are provided to minimize movement between said wear plate and said side frame comprising a stop on said side frame in engagement with said wear plate.

7. The wear plate of claim 6 wherein a pair of stops are provided on said side frame, said stops being engageable with corresponding ends of one of said lips.

* * * * *